US006964360B2

(12) United States Patent
Tubman et al.

(10) Patent No.: US 6,964,360 B2
(45) Date of Patent: Nov. 15, 2005

(54) ADJUSTABLE CLOTHES HANGER

(75) Inventors: Casey J. Tubman, St. Joseph, MI (US); David G. Cockrell, Pekin, IL (US); Michael A. Dirlam, St. Joseph, MI (US); Dale E. Mueller, Benton Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 14 days.

(21) Appl. No.: 10/622,161

(22) Filed: Jul. 17, 2003

(65) Prior Publication Data

US 2005/0011917 A1 Jan. 20, 2005

(51) Int. Cl.[7] ..... A41D 27/22
(52) U.S. Cl. ..... 223/85; 223/89
(58) Field of Search ..... 223/85, 94, 89, 223/88, 90, 91, 92, 93, 96

(56) References Cited

U.S. PATENT DOCUMENTS

| | | | | | |
|---|---|---|---|---|---|
| 923,786 | A | | 6/1909 | Geraci | |
| 2,436,314 | A | | 2/1948 | Lesavoy | 223/89 |
| 2,504,562 | A | | 4/1950 | Melcher | 223/89 |
| 2,679,958 | A | | 6/1954 | Massa et al. | 223/89 |
| 2,716,512 | A | * | 8/1955 | Needles | 223/89 |
| 2,724,533 | A | * | 11/1955 | Hansen | 223/94 |
| 2,900,117 | A | | 8/1959 | Veltry | 223/94 |
| 2,944,711 | A | | 7/1960 | Sage | 223/94 |
| 3,039,662 | A | | 6/1962 | Strong | 223/89 |
| 3,874,572 | A | | 4/1975 | McClenning | 223/94 |
| 4,717,053 | A | | 1/1988 | Wang | 223/94 |
| 5,085,358 | A | | 2/1992 | Lam | 223/94 |

FOREIGN PATENT DOCUMENTS

| | | |
|---|---|---|
| CH | 887020 | 1/1962 |

* cited by examiner

*Primary Examiner*—Gary L. Welch
(74) *Attorney, Agent, or Firm*—John F. Colligan; Robert O. Rice; Stephen Krefman

(57) ABSTRACT

A clothes hanger is provided. The clothes hanger includes a first main arm connected with a second main arm. Each main arm forms an adjustment element and a primary track. The clothes hanger also includes first and second adjustable arms each movably and pivotally connected with one respective main arm. Each adjustable arm includes a locator element engageable with a respective adjustment element and a primary sliding member received in each primary track.

14 Claims, 2 Drawing Sheets

Fig. 1
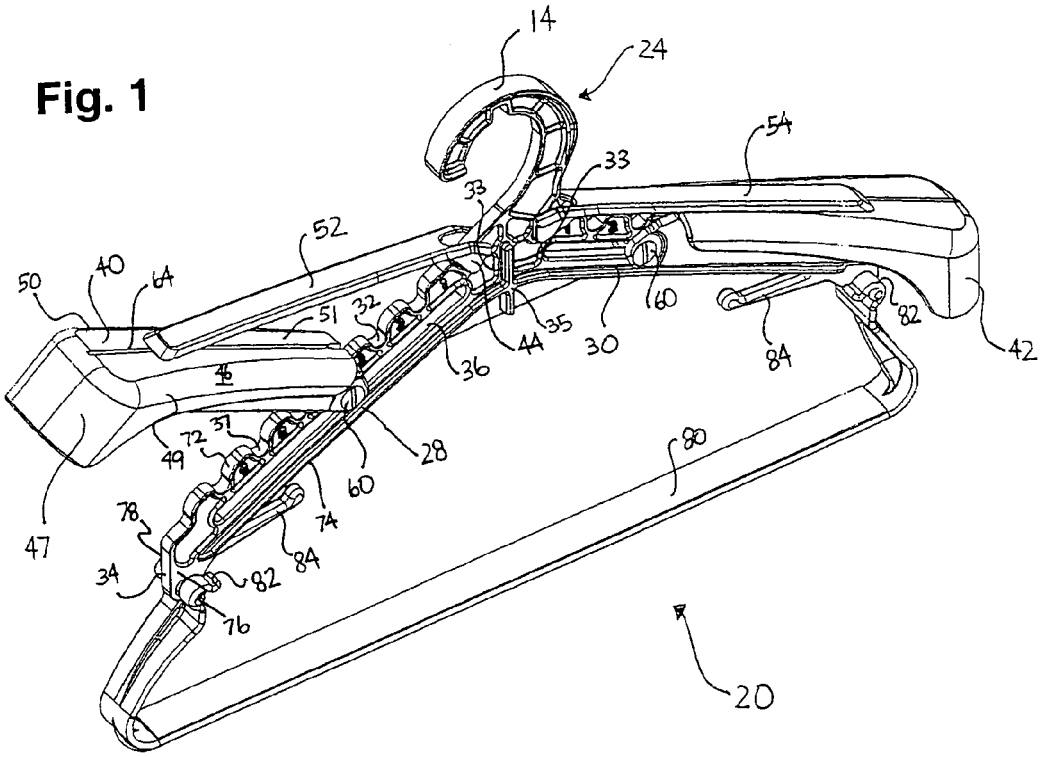
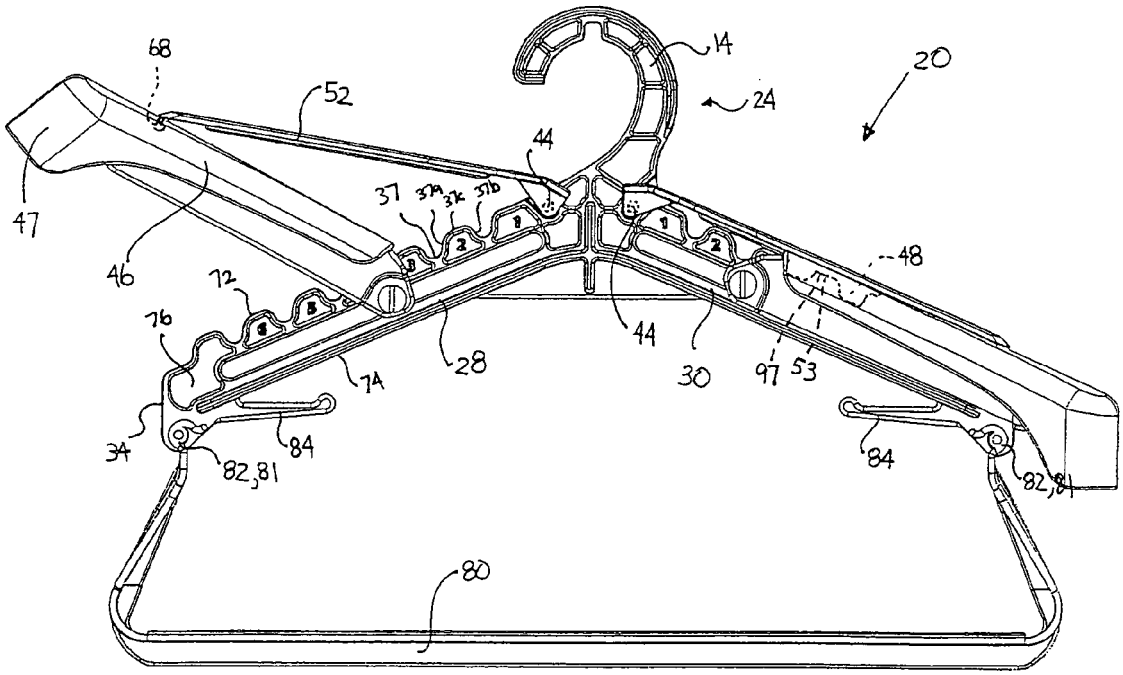
Fig. 2

ADJUSTABLE CLOTHES HANGER

BACKGROUND OF THE INVENTION

The present invention relates to clothes hangers, and more particularly, to an adjustable clothes hanger with improved anti-wrinkle performance.

Clothes hangers of fixed construction have the disadvantage that clothing of different styles and shapes and sizes do not all fit on the hanger equally well. As a result, clothes which are misfit to the shape or size of the hanger, hang in a deformed manner which causes wrinkling and misshaping of the cloth. The following are exemplary of the prior art; U.S. Pat. Nos. 923,786; 2,436,314, 2,494,711; 2,504,562; 2,679,958, 2,716,512; 2,900,117; 2,944,711; 3,039,662; 3,874,572 and 4,717,053 and United Kingdom Patent 887,020.

Illustratively, U.S. Pat. No.5,085,358 to Lam, discloses a clothes hanger of the type in which the hanger arms for supporting clothing are adjustable in length. In particular, the clothes hanger includes elongated main arms each having a top side. Locator elements comprising a series of recesses are formed in the bottom surface extending along the length of each main arm. The clothes hanger also has adjustable arms that have top walls and that define channels for slidably and pivotally interfitting with the elongated main arms.

One problem associated with this type of clothes hanger is that the top sides of the main arms and the top walls of the adjustable arms are not continuous and flat, in that there is a ridge that is formed where the top sides meet the top walls. Such a ridge may cause clothes that are hung on this type of hanger to form a wrinkle. Accordingly, it would be an improvement to provide an adjustable hanger that has a more continuous and flat top side to prevent wrinkling of clothes.

SUMMARY OF THE INVENTION

According to one aspect of the present invention, a clothes hanger is provided. The clothes hanger includes an attachment member and first and second main arms extending from the attachment member. Each main arm forms an adjustment element. The clothes hanger also includes first and second adjustable arms and first and second cover arms. The first and second adjustable arms are each movably connected with one respective main arm. Each adjustable arm includes a locator element engageable with a respective adjustment element. The first and second cover arms are each connected with a respective adjustable arm and a respective main arm.

According to another aspect of the present invention, a clothes hanger is provided. The clothes hanger includes an attachment member and first and second main arms extending from the attachment member. Each main arm forms an adjustment element and a primary track. The clothes hanger also includes first and second adjustable arms each movably and pivotally connected with one respective main arm. Each adjustable arm includes a locator element engageable with a respective adjustment element and a primary sliding member received in a respective primary track.

According to another aspect of the present invention, a clothes hanger is provided. The clothes hanger includes a first main arm connected with a second main arm. Each main arm forms an adjustment element and a primary track. The clothes hanger also includes first and second adjustable arms each movably and pivotally connected with one respective main arm. Each adjustable arm includes a locator element engageable with a respective adjustment element and a primary sliding member received in each primary track.

BRIEF DESCRIPTION OF THE DRAWING

FIG. 1 is a front perspective view of an adjustable clothes hanger, in accordance with one embodiment.

FIG. 2 is a front view of the adjustable clothes hanger shown in FIG. 1, in accordance with one embodiment.

Figure 3:
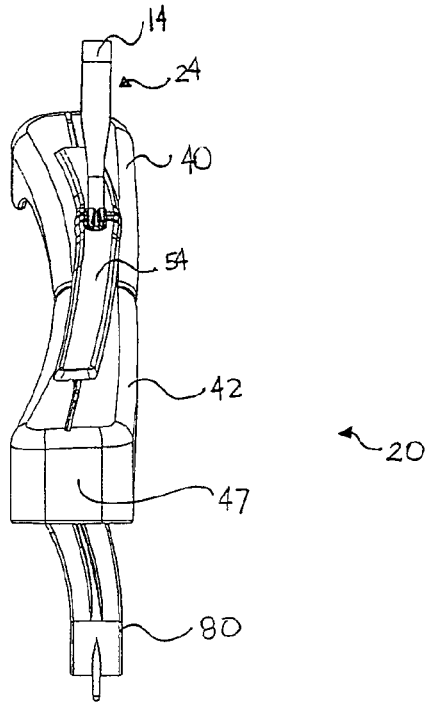
FIG. 3 is a side perspective view of the adjustable clothes hanger shown in FIG. 1, in accordance with one embodiment.

It should be appreciated that for simplicity and clarity of illustration, elements shown in the Figures have not necessarily been drawn to scale. For example, the dimensions of some of the elements are exaggerated relative to each other for clarity. Further, where considered appropriate, reference numerals have been repeated among the Figures to indicate corresponding elements.

DETAILED DESCRIPTION OF THE PREFERRED EMBODIMENT

The present invention relates to an adjustable clothes hanger for hanging garments. The clothes hanger includes first and second main arms connected with each other, wherein each main arm forms an adjustment element. Preferably, each main arm forms a primary track as well. The clothes hanger also includes first and second adjustable arms each movably and pivotally connected with one respective main arm, wherein each adjustable arm includes a locator element engageable with a respective adjustment element. Preferably, each adjustable arm includes a primary sliding member received in each primary track. In one embodiment, the adjustable clothes hanger includes cover arms to provide a continuous surface for the garments to rest upon, and therefore reducing the amount of wrinkles in the garments once the garments have been placed on the adjustable clothes hanger.

Figure 4:
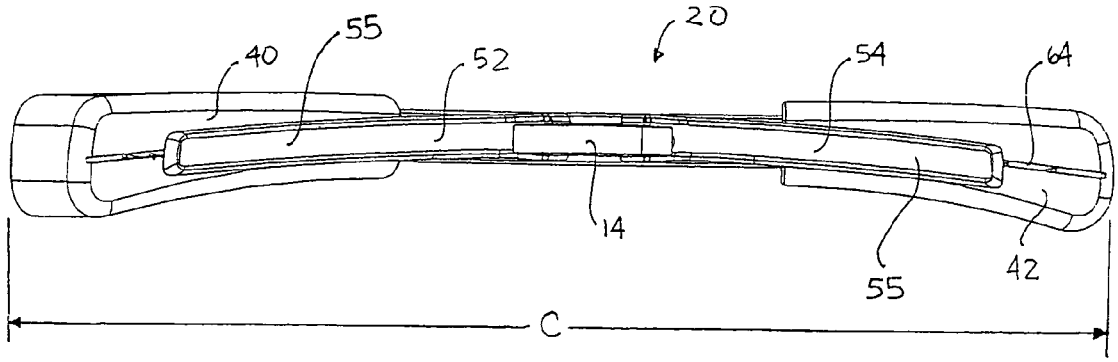
FIG. 4 is a top view of the adjustable clothes hanger shown in FIG. 1, in accordance with one embodiment.

Referring to FIGS. 1 through 4, an adjustable clothes hanger 20 in accordance with the present invention includes an attachment member 24 and first and second main arms 28, 30 each having an inner end 33 and an outer end 34. Preferably, the adjustable clothes hanger 20 also includes cover arms 52, 54, as described below. The main arm inner ends 33 are mounted proximate to one another as by a junction 35 with the main arms 28, 30 diverging symmetrically therefrom by an included angle of preferably between 120 and 170 degrees, and more preferably between 140 and 160 degrees. The attachment member 24 is placed centrally atop the junction 35. The attachment member 24 may include any device or member that can be used to attach the clothes hanger 20 to another member, including: a mechanical device, such a hook 14, a hook and loop type fastener such as VELCRO™, a snap-fit member, a loop, and a clamp; an adhesive device such as glue; and other such devices. Each main arm 28, 30 forms a number of sides. In one embodiment, the main arms 28, 30 form four sides, a top side 72, a bottom side 74, a forward side 76, and a rear side 78. The four sides may be generally rectangular in cross section, wherein the forward and rear sides 76, 78 are generally parallel and the top and bottom sides 72, 74 are also generally parallel. Each main arm 28, 30 forms an adjustment element 32 that preferably includes a series of recesses 37 formed in a side, such as the top side 72, extending along a length of each main arms 28, 30. Preferably, at the end of each main arm 28, 30 is a hook 84 which extends inwardly.

A cross bar 80 extends generally between the outer ends 34, being attached thereto by attachment members 81. In one embodiment the attachment members 81 removably attach the cross bar 80 each main arm 28, 30. In this embodiment, the attachment member 81 may be snap-fit members 82, or any other such devices, that may be used to removably attach the cross bar 80. Preferably, each main arm 28, 30 also forms a primary track 36 for receiving a primary sliding member 60 of an adjustable arm 40, 42, as described below.

The forward side 76, rear side 78, top side 72, and bottom side 74 extend along the length of each main arm 28, 30 between the inner end 33 and the outer end 34 except for interruption of the top side 72 by interposition of the recesses 37 as now to be described. While the recesses 37 in the current embodiment are formed on the top side 72, the recesses 37 may be formed on any side 72, 74, 76, 78 of the main arms 28, 30. In one embodiment, the recesses 37 are formed in the primary track 36. Forming recesses 37 in the primary track allows the adjustable arms 40, 42 to lift out of the adjustment element 32 without having to pivot. The recesses 37 of the illustrated embodiment are upwardly open formed by walls having three segments, opposed lateral segments 37*a* and 37*b* and an upper segment 37*c*. As shown all of these segments are smoothly joined curves; but they could be discretely segmented such as flat, and joined at corners. The size of the recesses 37 and in particular the space between lateral segments 37*a* and 37*b*, as will be apparent, is based on a determination of how finely it is desired to adjust the length of the hanger arms, that is, the effective hanger length provided by the combination of the main arms 28, 30 and adjustable arms 40, 42 connected with the main arms 28, 30, as described below. Reducing the distance between recesses 37 will allow finer adjustment and increasing the distance between recesses 37 will allow coarser adjustment. The length of the series of recesses 37 between the inner ends 33 and outer ends 34 of the main arms 28, 30 is determined by the length of the adjustable arms 40, 42 and the desired fully extended effective length of the clothes hanger 20. The depth of the recesses 37 is chosen to provide secure positioning as well as straight alignment of the adjustable arms 40, 42 on the main arms 28, 30.

As shown in FIGS. 1 through 4, the first adjustable arm 40 and the second adjustable arm 42 are each movably and pivotally connected with one of the respective main arms 28, 30. Each adjustable arm 40, 42 includes a locator element 48 engageable with a respective adjustment element 32, and more particularly, engageable with a respective recess 37, as illustrated in FIG. 2. The adjustable arms 40, 42 have a body 46 preferably having a U-shaped cross section that is downwardly open, formed from a front side wall 49 and a rear side wall 50 and a top wall 51, which present opposed inner side surfaces and a top inner surface. Top wall 51 defines a secondary track 64 for slidably and pivotally interfitting with a secondary sliding member 68 of each cover arm 52, 54, as described below. The adjustable arms 40, 42 have the locator element 48 comprising a protrusion 53 formed at the top inner surface 97 of the adjustable arms 40, 42. Preferably, the adjustable arms 40, 42 include a primary sliding member 60 each movably connected with a respective primary track 36. More preferably, the primary sliding member 60 is movably and pivotally connected with a respective primary track 36 of one main arm 28, 30. In this manner, the primary sliding member 60 allows for sliding and pivoting one of the adjustable arms 40, 42 such that the respective locator element 48 may move in and out of engagement with the respective adjustment element 32. Preferably, the adjustable arms 40, 42 are also equipped with a shoulder pad 47 which is shaped to support the shoulder of an item of clothing. Preferably, the shoulder pad 47 is integrally formed with each adjustable arm 40, 42 at an outer end thereof.

The adjustable arms 40, 42 are preferably formed of molded rigid plastic, as are the main arms 28, 30, the attachment member 24, the junction 35, and the cover arms 52, 54. While in the above described structure, the primary sliding member 60 is pressed into holes formed in the body 46 of the adjustable arms 40, 42, the entire adjustable arms 40, 42, including the primary sliding member 60, could be constructed of one piece of molded plastic. In order to enable assembly of the one piece adjustable arms 40, 42 of this configuration onto the main arms 28, 30, the primary track 36 formed in each main arm 28, 30 would have to be open at some point along the length of the primary track 36, so as to allow the primary sliding member 60 to slide directly into the primary track 36.

The first and second cover arms 52, 54 are each pivotally connected with a respective main arm 28, 30 and movably connected with a respective adjustable arm 40, 42. The cover arms 52, 54 cover at least a portion of the top side 72 of each main arm 28, 30 and at least a portion of the top wall 51 of each adjustable arm 40, 42 to provide a continuous surface 55 for a garment to rest upon, and therefore reducing the amount of, or preventing the formation of, wrinkles in a garment once the garment has been placed on the adjustable clothes hanger 20. Preferably, the cover arms 52, 54 also cover a portion of the secondary track 64 on each adjustable arm 40, 42. Preferably, the cover arms 52, 54 include the secondary sliding member 68 each movably connected with a respective secondary track 64. More preferably, the secondary sliding member 68 is movably and pivotally connected with a respective secondary track 64 of one adjustable arm 40, 42. In this manner, the secondary sliding member 68 allows for sliding and pivoting one of the cover arms 52, 54 relative to a respective adjustable arm 40, 42. Preferably, the cover arms 52, 54 include a pivoting member 44 that is pivotally connected with a respective main arm 28, 30. The pivoting member 44 may be one of a variety of devices which allow for pivoting between two elements, such as, a pin, a snap-fit arrangement, a wheel, a cylinder, and a gear.

In operation, as seen in FIGS. 1–4, the adjustable arms 40, 42 extend beyond the outer end 34 of the main arms 28, 30 thereby providing an extended effective length "C" of the clothes hanger 20 for supporting an item of clothing. The adjustable arms 40, 42 are each held in place by co-action of the primary sliding member 60, the locator element 48 and the adjustment element 32, which prevent longitudinal movement and downward pivoting of the adjustable arms 40, 42. Contact of the top wall 51 and, more specifically, the top inner surface 97 with the top side 72 of the main arms 28, 30 prevents downward pivoting. Contact of the front side wall 49 and the rear side wall 50 with the forward side 76 and the rear side 78 respectively of the main arms 28, 30 prevents twisting of the adjustable arms 40, 42. To change adjust the position of the clothes hanger 20, the adjustable arms 40, 42 are upward pivoted as shown in FIGS. 1–4 so that the locator element 48 pivots out of the adjustment element 32. Now the adjustable arms 40, 42, and more specifically, the primary sliding member 60, can slide along the main arms 28, 30, and more specifically, the primary track 36, to a new selected point, and can then be down-pivoted so that the locator element 48 rests in a new selected recess 37. The first and second cover arms 52, 54 each pivot with respect to a respective main arm 28, 30 and move or slide with respect to a respective adjustable arm 40, 42 so that when the adjustable arms 40, 42 are moved from one point to another, the cover arms are able to still cover at least a portion of the top side 72 of each main arm 28, 30 and at least a portion of the top wall 51 of each adjustable arm 40, 42 to provide a continuous surface 55 for a garment to rest upon.

The construction just described requires at least one separately constructed part in order to assemble the adjustable arms 40, 42 onto the clothes hanger 20. Preferably, the primary sliding member 60 would be made separately and pressed into holes 61 in the front side walls 49 and rear side wall 50 after mounting of the adjustable arms 40, 42 onto the main arms 28, 30. A number of alternative constructions are possible, including allowing the attachment member 24, the junction 35, and the main arms 28, 30 to be made of one piece.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

What is claimed is:

1. A clothes hanger comprising:

an attachment member;

first and second main arms extending from the attachment member and each forming an adjustment element;

first and second adjustable arms each movably connected with one respective main arm, wherein each adjustable arm includes a locator element engageable with a respective adjustment element;

first and second cover arms each connected with a respective adjustable arm and a respective main arm; and wherein the first and second cover arms are each pivotally connected with a respective main arm and movably connected with a respective adjustable arm.

2. The clothes hanger of claim 1, wherein the first and second main arms each forms a primary track, and the first and second adjustable arms each includes a primary sliding member movably connected within a respective primary track.

3. The clothes hanger of claim 1, wherein each adjustable arm forms a secondary track, and the first and second cover arms each includes a secondary sliding member each movably connected within a respective secondary track.

4. The clothes hanger of claim 1, wherein the adjustment element comprises a series of recesses extending along at least a portion of a length of each of the first and second main arms.

5. The clothes hanger of claim 1 further comprising a cross bar connected between the first and second main arms.

6. The clothes hanger of claim 5, wherein the cross bar is removably connected between the first and second main arms.

7. The clothes hanger of claim 1, wherein the first and second adjustable arms each include a primary sliding member pivotally connected with one respective main arm, wherein the primary sliding member allows for sliding and pivoting of the adjustable arm such that the locator element may move in and out of engagement with a respective adjustment element.

8. A clothes hanger comprising:

an attachment member;

first and second main arms extending from the attachment member and each forming an adjustment element and a primary track;

first and second adjustable arms each movably and pivotally connected with one respective main arm wherein each adjustable arm includes a locator element engageable with a respective adjustment element and a primary sliding member received in a respective primary track;

first and second cover arms each connected with a respective adjustable arm and a respective main arm; and wherein the first and second cover arms are each pivotally connected with a respective main arm and movably connected with a respective adjustable arm.

9. The clothes hanger of claim 8, wherein each adjustable arm forms a secondary track, and the first and second cover arms each includes a secondary sliding member each movably connected within a respective secondary track.

10. The clothes hanger of claim 8, wherein the adjustment element comprises a series of recesses extending along at least a portion of a length of each of the first and second main arms.

11. The clothes hanger of claim 8 further comprising a cross bar connected between the first and second main arms.

12. A clothes hanger comprising:

a first main arm connected with a second main arm, wherein each main arm forms an adjustment element and a primary track;

first and second adjustable arms each movably and pivotally connected with one respective main arm, wherein each adjustable arm includes a locator element engageable with a respective adjustment element and a primary sliding member received in each primary track;

first and second cover arms each connected with a respective adjustable arm and a respective main arm; and wherein the first and second cover arms are each pivotally connected with a respective main arm and movably connected with a respective adjustable arm.

13. The clothes hanger of claim 12, wherein each adjustable arm forms a secondary track, and the first and second cover arms each includes a secondary sliding member each movably connected within a respective secondary track.

14. The clothes hanger of claim 12 further comprising a cross bar connected between the first and second main arms.

* * * * *